United States Patent [19]

Elliott et al.

[11] Patent Number: 4,634,500

[45] Date of Patent: Jan. 6, 1987

[54] METHOD OF QUENCHING HEATED COKE TO LIMIT COKE DRUM STRESS

[75] Inventors: John D. Elliott, Randolph; Steven P. King, Succasunna, both of N.J.

[73] Assignee: Foster Wheeler Energy Corporation, Livingston, N.J.

[21] Appl. No.: 754,783

[22] Filed: Jul. 15, 1985

[51] Int. Cl.[4] ..... C10B 39/04; C10B 39/06

[52] U.S. Cl. ..... 201/39; 202/227; 374/45

[58] Field of Search ..... 201/1, 39; 202/227, 202/270; 374/33, 45, 46, 50, 55, 112; 208/131

[56] References Cited

U.S. PATENT DOCUMENTS 3,611,787 10/1971 D'Annessa et al. ..... 374/50
3,936,358 2/1976 Little ..... 201/39
4,168,224 9/1979 Jansma ..... 201/39
4,358,343 11/1982 Goedde et al. ..... 201/1
4,409,067 10/1983 Smith ..... 201/1

*Primary Examiner*—Barry S. Richman
*Assistant Examiner*—Joye L. Woodard
*Attorney, Agent, or Firm*—Marvin A. Naigur; John E. Wilson; Robert D. Bajefsky

[57] ABSTRACT

The present invention provides a method of quenching heated coke in a coke drum. Quench water is fed into the coke drum to cool the coke, and the stress in the coke drum wall is monitored during the quenching. The rate of feeding the quench water into the coke drum is regulated to prevent the stress in the coke drum wall from exceeding a predetermined limit. The stress is monitored by measuring either the longitudinal thermal gradient or the rates of change in the drum wall temperature over time.

17 Claims, 5 Drawing Figures

METHOD OF QUENCHING HEATED COKE TO LIMIT COKE DRUM STRESS

BACKGROUND OF THE INVENTION

The present invention relates generally to the quenching of heated coke and, more particularly, to a method of quenching heated coke to limit the amount of stress incurred by a coke drum containing the heated coke.

In a delayed coking process, the coke drum must be cooled after it is filled with hot coke to allow safe removal of the coke from the drum. Usually, water is injected into the coke drum to quench both the hot coke and the drum to a safe temperature level. In order to prevent undue stress which may cause damage to the drum, the rate at which the quench water is introduced must be controlled. A number of control methods have been used.

One method limits the quench rate to a predetermined maximum limit that will safely minimize metallurgical stresses caused by longitudinal thermal gradients in the drum. Such a method ensures a long operating life for the coke drum, regardless of the actual dynamic conditions encountered during the quenching. Usually, in this method, the quench water is introduced into the drum in a stepwise rate sequence.

Since each coke drum has unique quench characteristics for the particular coke formed in the coke drum, it is time consuming to establish a quench sequence for each batch of coke. Typically, to prevent excessive metallurgical stresses regardless of the batch of coke in the drum, the quench period is set for an extended time period. In practice, high stresses are imposed on the coke drum, because it is impossible to predict the variations in coke drum response during the quenching process. The accumulated result of periodically induced high metallurgical stresses either reduces the useable life of the coke drum or increases the maintenance repair costs.

A second quench method adjusts the quench rate to result in as rapid a quenching of the coke and drum as will be tolerated, without increasing the internal pressure of the drum above a maximum limit. The buildup of internal pressure in the drum is due to the vaporization of the quench water to form steam, which must be vented from the drum. This method usually results in an essentially constant drum internal pressure during the quenching procedure, and allows the quenching to occur in a short time period. The quench flow rate, in this method, may be adjusted manually by the operator, who monitors the coke drum internal pressure as indicated by the overhead pressure, to maximize the quench water flow rate.

Alternatively, as shown in U.S. Pat. No. 3,936,358 to James E. Little, an automatic control can be used to monitor the coke drum overhead pressure to maximize the quench water flow rate in response to the coke drum internal pressure. A substantially constant internal coke drum pressure is maintained. In another method, as shown in U.S. Pat. No. 4,358,343 to Franz Goedde et al., the quench rate is varied with time to maintain the vapor pressure decay rate, above the coke bed, in accordance with an ideal curve.

These previous methods often rely on periodic routine inspection and maintenance of the coke drum to detect and repair damage resulting from the accumulated effect of high metallurgical stresses imposed on the drum. Although such inspections and maintenance are expensive and time consuming, the quench time is reduced.

Quenching the coke drum at a maximum or a constant high internal coke drum pressure, however, leads to an eventual accumulation of inelastic strain in the coke drum. When a hot coke drum is quenched, a ring of high thermal stress forms in the coke drum from the significant differences in drum wall temperature over a small vertical or longitudinal distance. This high temperature differential over a small vertical distance is referred to as a longitudinal thermal gradient. These significant longitudinal thermal gradients are associated with a water level that rises through the coke drum.

A high longitudinal thermal gradient and an excessive internal coke drum pressure are the major contributors to the formation of stresses in the coke drum. Over a period of many coking cycles, the accumulation of inelastic strain and stress, in the metal of the coke drum, results in the metal bulging, cracking and thinning. This ultimately acts to decrease the lifetime of the coke drum.

SUMMARY OF THE INVENTION

It is therefore a main object of the present invention to provide a method of quenching heated coke in a coke drum which overcomes the aforementioned drawbacks.

It is a more specific object of the invention to provide a method of quenching heated coke in a coke drum which optimizes the stress and inelastic strain in the coke drum.

Another object of the invention is to provide a method of quenching heated coke in a coke drum which optimizes the lifetime of the coke drum.

Another object of the invention is to provide a method of quenching heated coke in a coke drum which optimizes the time required to quench the hot coke in the coke drum.

Additional objects and advantages of the invention will be set forth in part in the description which follows, and in part will be obvious from the description, or may be learned by practice of the invention. The objects and advantages of the invention may be realized and obtained by means of instrumentalities and combinations particularly pointed out in the appended claims.

To achieve these objects and in accordance with the purpose of the invention, the present invention provides a method of quenching heated coke in a coke drum, having a coke drum wall, comprising the steps of feeding quench water into the coke drum to cool the coke; monitoring the stress in the coke drum wall during the feeding of the quench water into the coke drum; and regulating the rate of feeding quench water into the coke drum to prevent the stress in the coke drum wall from exceeding a predetermined limit.

In one embodiment, the stress in the coke drum wall is monitored by measuring the longitudinal thermal gradient along the coke drum wall during the feeding of the quench water into the coke drum. The longitudinal thermal gradient measurements are compared with a predetermined gradient parameter of the coke drum.

In another embodiment, the stress in the coke drum wall is monitored by measuring the changes in the drum wall temperature, over time, during the feeding of the quench water into the coke drum. The changes in the drum wall temperature are compared with a predetermined temperature parameter for the coke drum.

The present invention obviates the problems associated with previous quenching techniques, and achieves the objects of the invention. The method of quenching heated coke of the present invention extends the lifetime of the coke drum by minimizing the stress and inelastic strain present in the coke drum wall, as a result of the quenching.

By regulating the rate of feeding quench water into the coke drum, the time required to quench the hot coke is optimized without causing significant damage to the coke drum. By ensuring a long coke drum lifetime and optimizing the coking schedule, the present invention allows for a savings in maintenance and operating cost, while maximizing the unit capacity of the coke drum.

The foregoing and other objects, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate various embodiments of the invention and, together with a description, serve to explain the principles of the invention.

DETAILED DESCRIPTION OF THE PREFERRED EMBODIMENT

Figure 1:
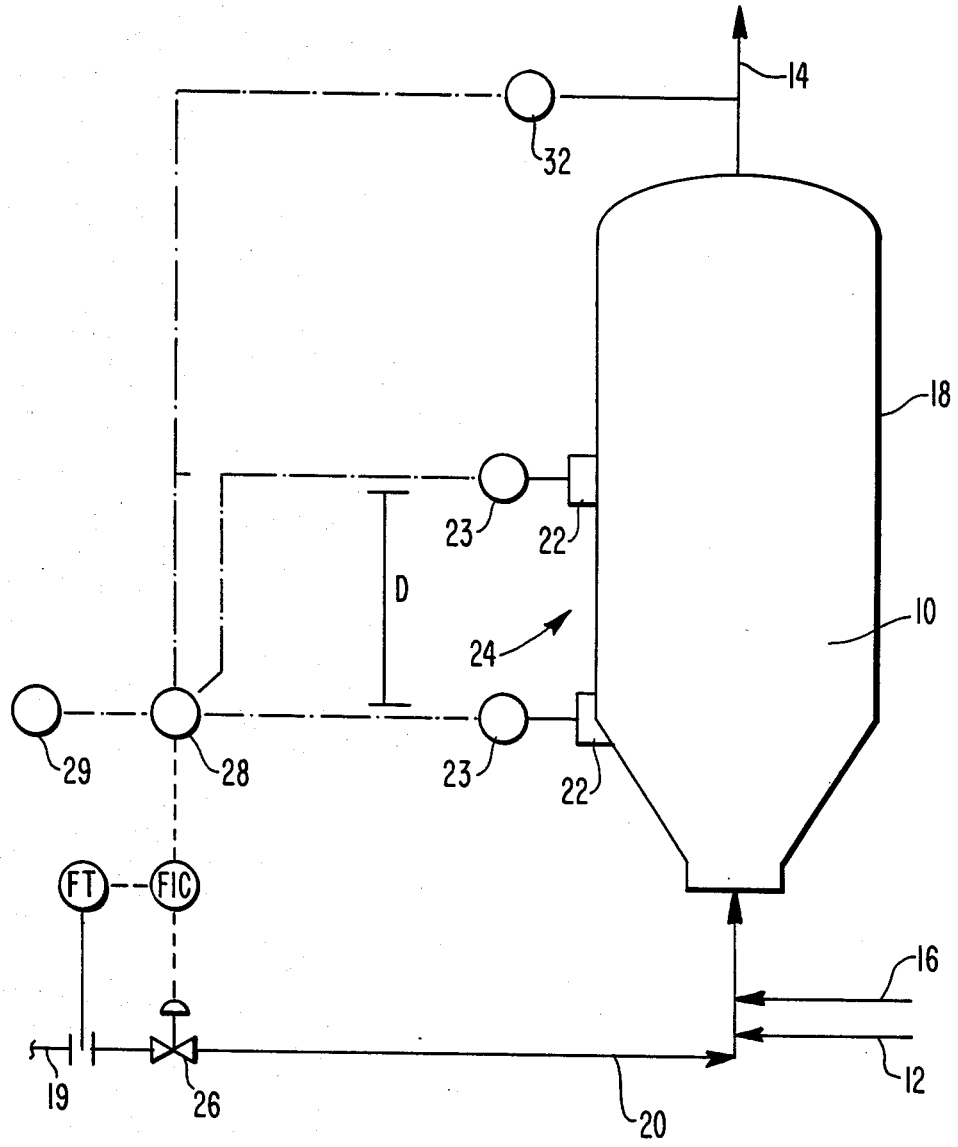
FIG. 1 is a schematic diagram of the present invention.

Reference will now be made in detail to the embodiments of the invention, which are illustrated in the accompanying drawings. As shown schematically in FIG. 1, a hydrocarbon feedstock, such as coal tar, or petroleum residue, is preheated and transferred to a coke drum 10 from a feedstock source 12. The feedstock in the drum 10 is heated to cause the destructive distillation of the hydrocarbon feedstock, and the formation of solid coke and relatively lighter hydrocarbon vapors. The hydrocarbon vapors are withdrawn from the coke drum 10 through a conduit 14.

After the destructive distillation has progressed a sufficient degree to fill substantially the coke drum 10 with coke, the flow of hydrocarbon feedstock into the coke drum 10 is stopped. Steam may be added, from a steam source 16, to the coke drum to remove residual hydrocarbon vapors from the coke. The hot coke is then ready to be quenched in accordance with the present invention.

A method of quenching heated coke in a coke drum having a coke drum wall in accordance with the present invention comprises the steps of feeding quench water into the coke drum to cool the coke, monitoring the stress in the coke drum wall during the feeding of the quench water into the coke drum, and regulating the rate of feeding quench water into the coke drum to prevent the stress in the coke drum wall from exceeding a predetermined limit.

As embodied herein, the heated coke in the coke drum 10, having a coke drum wall 18, is quenched by feeding quench water 19 into the coke drum 10, through a conduit 20, to cool the hot coke. The stress in the coke drum wall 18 is monitored during the feeding of the quench water into the coke drum 10. The rate of feeding the quench water into the coke drum 10 is regulated to prevent the stress in the coke drum wall 18 from exceeding a predetermined limit.

Figure 2:
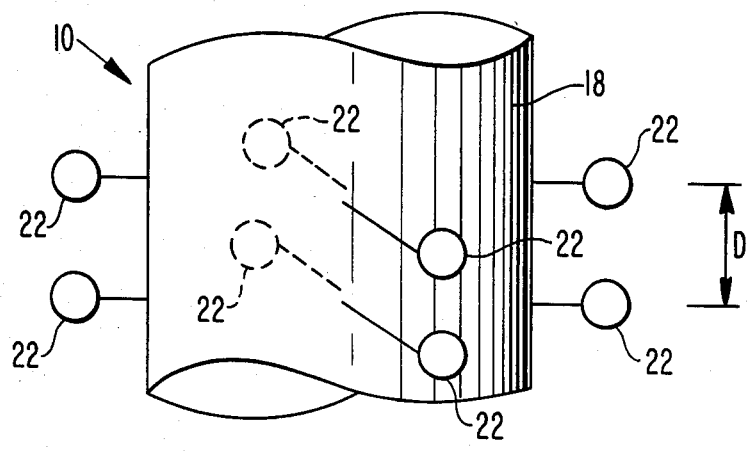
FIG. 2 is a perspective view of a portion of the coke drum of FIG. 1 showing the positioning of the temperature sensing devices along the coke drum wall.
Figure 3:
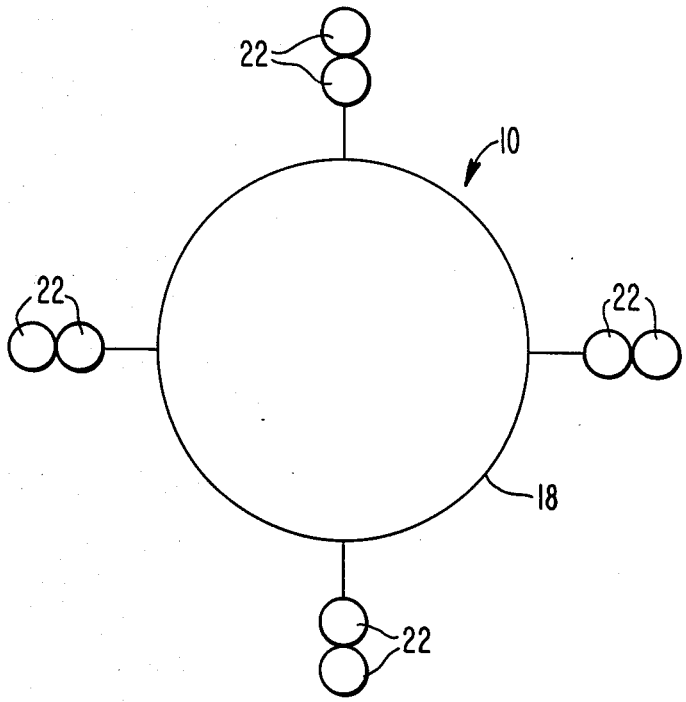
FIG. 3 is a top view of the coke drum shown in FIG. 2.

In one embodiment, as shown in FIGS. 2 and 3, the stress in the coke drum wall 18 is monitored by measuring the longitudinal thermal gradient along the coke drum wall 18 during the feeding of the quench water into the coke drum 10. The longitudinal thermal gradient is the difference in the temperature of the drum wall 18 over a short vertical or longitudinal distance D. The longitudinal thermal gradients are associated with a water level that rises up the coke drum 10, during the quenching process.

The longitudinal thermal gradient along the coke drum wall 18 is measured by positioning two or more sensing devices 22 vertically adjacent to each other along the coke drum wall 18, as shown in FIGS. 1 to 3. Each sensing device 22 has a relay control device 23 that converts the output from the sensing device 22 to a useful and measurable signal of the desired measurements from the drum wall 18. The temperature difference between two adjacent temperature sensing devices 22, when divided by the distance D separating them, provides the longitudinal thermal gradient for a section 24 of the coke drum wall 18.

To ensure an accurate prediction of applied stress to the coke drum wall 18, as correlated by measured longitudinal thermal gradient, several groups of temperature sensing devices 22 should be placed at various levels along the drum wall 18. The placement provides an adequate measurement of longitudinal thermal gradients during the entire quenching process. At each elevation, as shown in FIG. 3, four groups of temperature sensing devices 22 may be placed equidistantly around the circumference of the coke drum 10.

The measured longitudinal thermal gradients are compared with a predetermined gradient parameter for the coke drum. Preferably, a computer operated control device 28 calculates and compares the longitudinal thermal gradient measurements with the predetermined gradient parameter and, accordingly, regulates the quench water flow to prevent undue stress on the coke wall 18. The control device 28 can be one of those known in the art.

The rate of feeding the quench water into the coke drum is regulated by decreasing or increasing the quench water feed rate in view of the comparison made by the control device 28. A valve 26 responds to the control device 28 to regulate the rate of quench water feed into the drum 10. When the longitudinal thermal gradient exceeds the predetermined gradient parameter, the flow of quench water into the coke drum 10 is decreased. Once the value of the longitudinal thermal gradient falls below the predetermined gradient parameter, the flow of quench water into the coke drum 10 can be again increased.

The maximum longitudinal thermal gradient parameter is determined for the specific metallurgical characteristics of a particular drum 10 to account for maximum possible metallurgical stresses due to the longitudinal thermal gradients. Each coke drum 10 has a particular maximum gradient parameter that depends upon its specific metallurgical characteristics.

Figure 4:
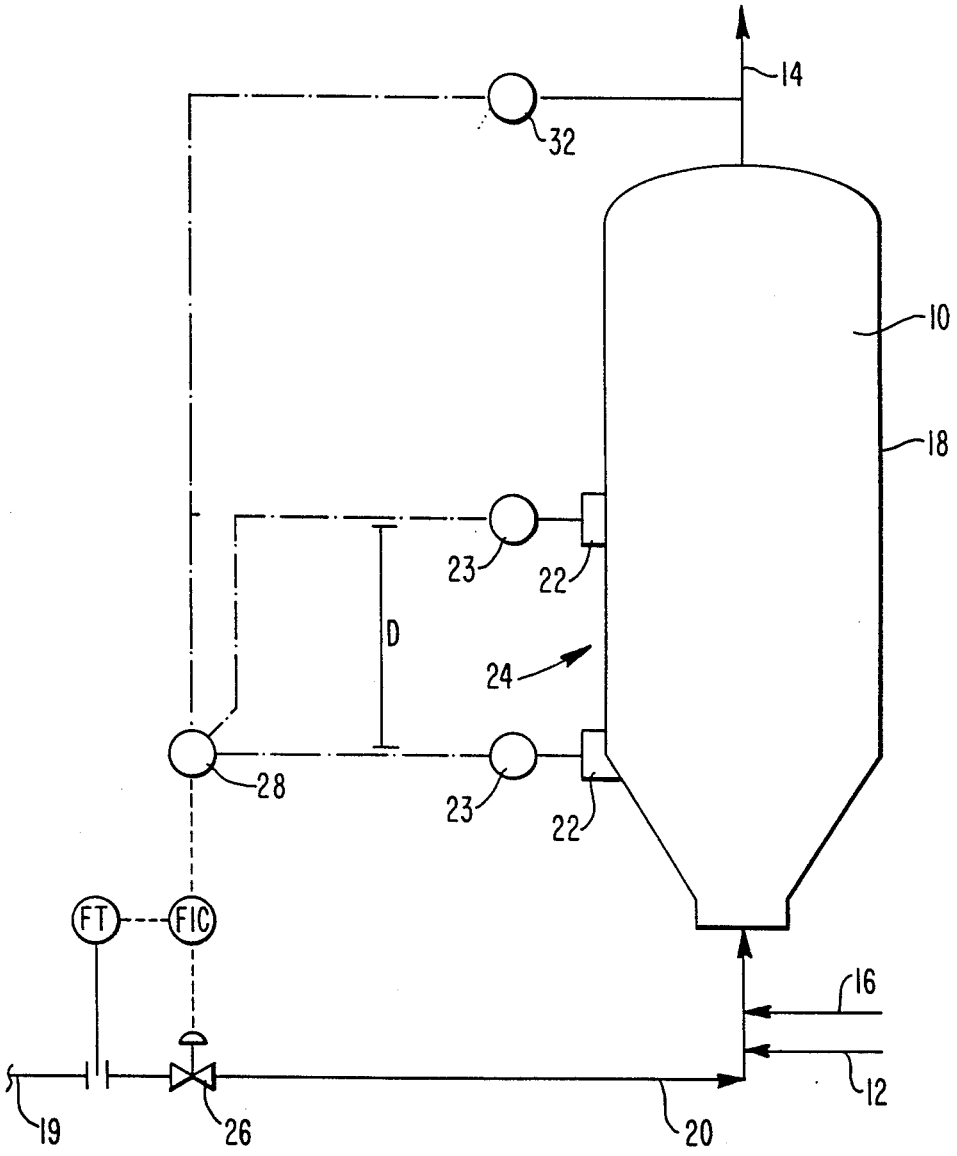
FIG. 4 is a schematic diagram showing another embodiment of the present invention.

Alternatively or in conjunction with the measuring of the longitudinal thermal gradient, the stress in the coke drum wall 18 is monitored by measuring the changes in the temperature of the drum wall 18 over time, during the feeding of the quench water into the coke drum 10. The changes in drum wall temperature over time are compared with a predetermined temperature-time parameter for the particular coke drum 10. As with the measurement of the longitudinal thermal gradient, the drum wall temperature changes can be measured by positioning one or more temperature sensing devices 22 having a relay control device 23, on the coke drum wall 18, as shown in FIG. 4.

Preferably, at least four temperature sensing devices 22 are equally spaced along the circumference of the coke drum wall 18, at a given level of the coke drum wall 18. As with the measurement of the longitudinal thermal gradient, a computer operated control device 28 can be used to compare the drum wall temperature rate changes with a predetermined temperature rate parameter. The rate of quench water feed into the coke drum 10 is regulated by the control device 28.

When the rate of temperature change of the drum wall 18 exceeds a predetermined temperature rate parameter, the flow of quench water into the drum 10 is decreased by control device 28 acting on the valve 26. As with the predetermined thermal gradient parameter, the predetermined temperature rate parameter varies with the design and metallurgical properties of the specific coke drum 10.

The control device 28 can be used to govern the quench water flow rate in a number of ways. For example, in FIG. 1, the control device 28 increases the quench water flow rate according to a predetermined quench schedule 29 that is programmed into the computer operated control device 28. The control device 28 measures the stress in the coke drum wall 18 by measuring the longitudinal thermal gradients or the temperature changes over time. If the stress in the coke drum wall 18 exceeds a safe maximum, then the predetermined quench rate schedule 29 will be overriden by the control device 28. The quench water flow rate is decreased until the coke drum stress has fallen below a safe value. When the measured coke drum stress has returned to a value below a safe maximum, the predetermined quench schedule 29 will again be resumed.

Alternatively, as presented in FIG. 4, the control device 28 measures the stress in the coke drum wall 18 by measuring the longitudinal thermal gradients or temperature changes over time. The quench water flow rate is always regulated by the control device 28 in response to the longitudinal thermal gradients or temperature changes, instead of in response to the predetermined quench rate schedule 29. The control device 28 ensures that the stress in the drum wall 18 will not exceed a safe maximum or increase at too high of a rate.

In addition to monitoring the stress in the coke drum wall 18 by measuring the longitudinal thermal gradient or the temperature changes over time, the internal pressure in the drum can also be monitored, during the feed of quench water into the drum, to prevent the pressure from exceeding a predetermined pressure limit. Part of the stress applied to the coke drum wall during the quenching process is due to the internal coke drum pressure. The metallurgical stress related to the maximum allowable internal coke drum pressure for a particular coke drum 10 varies as the specific coke drum metal wall temperatures varies. The net result is that the maximum allowable internal coke drum pressure is variable over the course of the quenching process, and does not remain essentially constant.

As shown in FIGS. 1 and 4, the internal coke drum pressure at any level in the coke drum 10 may be determined by measuring the coke drum overhead pressure by a pressure sensing device 32, and adding contributions from the pressure drop through the coke bed and the height of accumulated water. The pressure measurement is fed into the computer operated control device 28.

If the internal coke drum pressure approaches or exceeds a maximum safe value, either the predetermined schedule 29 will be overriden by the control device 28, as shown in FIG. 1, or the control device 28 will regulate the quench water flow in response to the pressure reading provided by the pressure sensing device 32, as shown in FIG. 4. The quench water flow rate is decreased until the internal coke drum pressure falls below a safe maximum. When the internal pressure is again below the safe maximum for the particular drum 10, either the predetermined schedule will be resumed, as in FIG. 1, or the control device 28 will regulate the quench water flow into the drum 10, as in FIG. 4.

By monitoring both the longitudinal thermal gradients or drum wall temperature changes and the internal coke drum pressure, a more accurate prediction of the mechanical stress applied to the coke drum wall 18, during the quenching process, is obtained. In the present invention, however, the quench water flow rate is not maximized within the limits imposed by the drum internal pressure; rather, the flow rate is established to extend or maximize the coke drum lifetime based upon the longitudinal thermal gradients or drum wall temperature changes over time.

Figure 5:
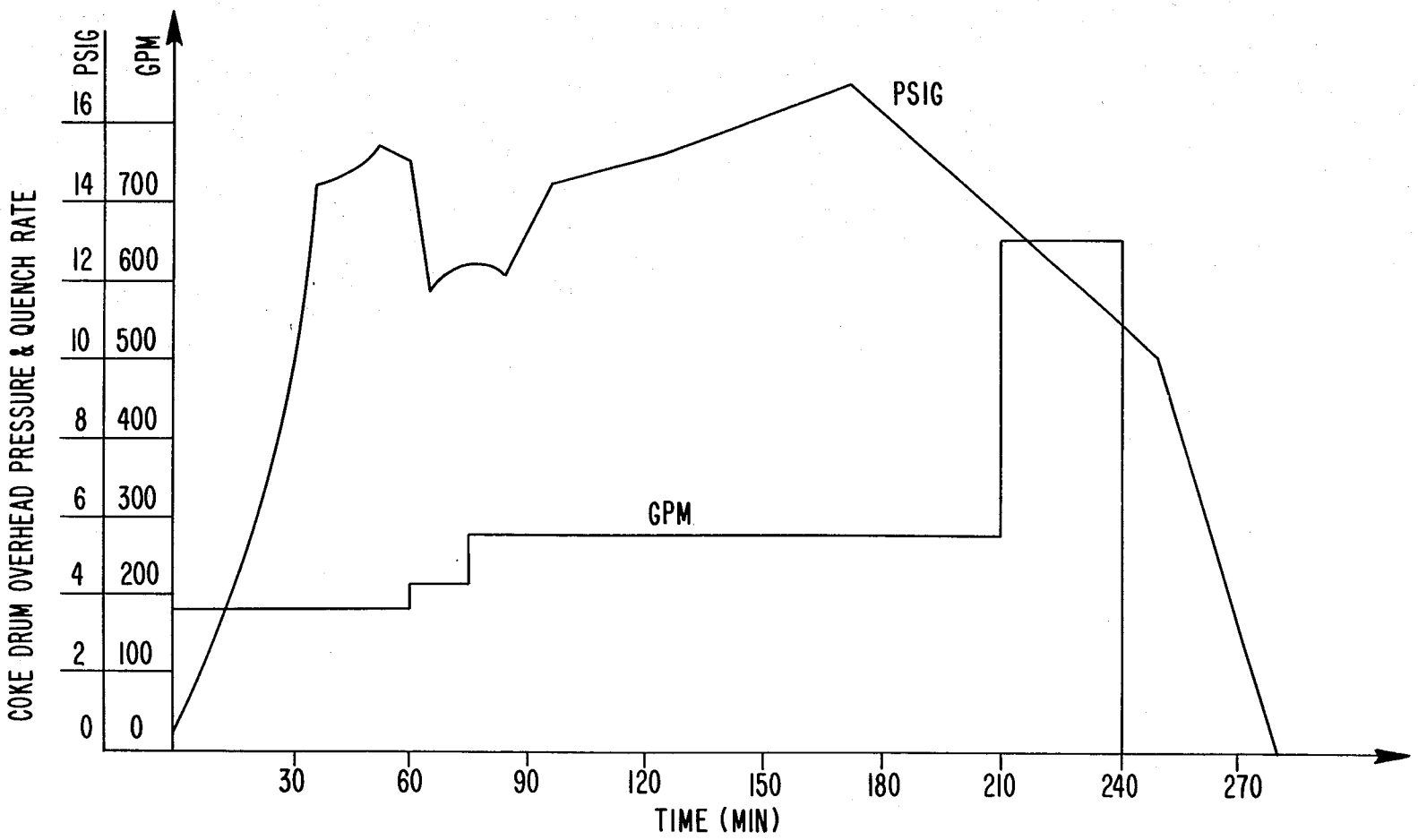
FIG. 5 is a diagram showing the predicted coke drum overhead pressure and the predicted quench rate as a function of time in a coke drum.

FIG. 5 provides a predicted profile of the internal coke drum pressure PSIG as a function of time. FIG. 5 further shows the predicted quench water flow rate GPM (Gallons Per Minute) into the drum over time, with respect to the predicted internal coke drum pressure PSIG.

It will be apparent to those skilled in the art that various other modifications and variations could be made in the present invention without parting from the scope and content of the invention.

What is claimed is:

1. A method of quenching heated coke in a coke drum, having a coke drum wall comprising the steps of:

(a) feeding quench water into the coke drum to cool the coke;

(b) measuring a longitudinal thermal temperature gradient along the coke drum wall during the feeding of the quench water into the coke drum;

(c) comparing the longitudinal thermal temperature gradient measurements with a predetermined gradient parameter for the coke drum; and (d) regulating the rate of feeding quench water into the coke drum as a function of the comparison of the measured longitudinal thermal temperature gradient with the predetermined gradient parameter to minimize stress in the coke drum wall.

2. The method of quenching heated coke of claim 1, wherein the longitudinal thermal gradient along the coke drum wall is measured by positioning two or more temperature sensing devices vertically adjacent to each other along the coke drum wall.

3. The method of quenching heated coke of claim 2, wherein the temperature sensing devices are organized in groups at different levels of the coke drum wall.

4. The method of quenching heated coke of claim 3, wherein the temperature sensing devices of each group are equally spaced along the circumference of the coke drum wall.

5. The method of quenching heated coke of claim 1, wherein the longitudinal thermal gradient measurement is compared with a predetermined gradient parameter for the coke drum by a computer operated control device.

6. The method of quenching heated coke of claim 1, wherein the rate of feeding quench water into the coke drum is regulated by decreasing the feed rate when the longitudinal thermal gradient exceeds a predetermined gradient parameter.

7. The method of quenching heated coke of claim 1, further comprising the step of monitoring the internal pressure in the coke drum during the feeding of the quench water into the coke drum.

8. A method of quenching heated coke in a coke drum having a coke drum wall comprising the steps of:

(a) feeding quench water into the coke drum to cool the coke;

(b) measuring a rate of change in the coke drum wall temperature over time during the feeding of the quench water into the coke drum;

(c) comparing said rate of change in the coke drum wall temperature with a predetermined temperature rate parameter for the coke drum; and (d) regulating the rate of feeding quench water into the coke drum as a function of the comparison of the rate of change in the measured coke drum wall temperature with the predetermined temperature rate parameter to minimize stress in the coke drum wall.

9. The method of quenching heated coke of claim 8, wherein the coke drum wall temperature changes are measured by positioning one or more temperature sensing devices on the coke drum wall.

10. The method of quenching heated coke of claim 9, wherein at least four temperature sensing devices are equally spaced along the circumference of the coke drum wall at a given level of the coke drum wall.

11. The method of quenching heated coke of claim 9, wherein the temperature sensing devices are organized in groups at different levels of the coke drum wall.

12. The method of quenching heated coke of claim 8, wherein the coke drum wall temperature changes are compared with a predetermined temperature rate parameter by a computer operated device.

13. The method of quenching heated coke of claim 8, wherein the rate of feeding quench water into the coke drum is regulated by decreasing the feed rate when the coke drum wall temperature exceeds a predetermined temperature rate parameter.

14. The method of quenching heated coke of claim 8, further comprising the step of monitoring the internal pressure in the coke drum during the feeding of the quench water into the coke drum.

15. The method of quenching heated coke of claim 14, further comprising the step of decreasing the rate of feeding quench water into the coke drum when the internal pressure in the coke drum exceeds a predetermined pressure limit.

16. A method of quenching heated coke in a coke drum having a coke drum wall comprising the steps of:

(a) feeding quench water into the coke drum to cool the coke;

(b) measuring both a longitudinal thermal gradient along the coke drum wall and a rate of change in the coke drum wall temperature over time during the feeding of the quench water into the coke drum;

(c) comparing both the longitudinal thermal gradient measurements with a predetermined gradient parameter and the rate of change in the coke drum wall temperature with a predetermined rate temperature parameter for the coke drum; and (d) regulating the rate of feeding quench water into the coke drum as a function of the comparisons to minimize stress in the coke drum wall.

17. The method of quenching heated coke of claim 16, further comprising the step of monitoring the internal pressure in the coke drum during the feeding of the quench water into the coke drum.

* * * * *